US009287666B2

(12) United States Patent
Walters et al.

(10) Patent No.: US 9,287,666 B2
(45) Date of Patent: Mar. 15, 2016

(54) ELECTRICAL CONNECTOR PLUG WITH KEY TO AVOID CONTACT DAMAGE

(75) Inventors: William A. Walters, Mentor, OH (US); Larry Crofoot, Perry, OH (US)

(73) Assignee: Cardioinsight Technologies, Inc., Cleveland, OH (US)

( * ) Notice: Subject to any disclaimer, the term of this patent is extended or adjusted under 35 U.S.C. 154(b) by 92 days.

(21) Appl. No.: 14/115,582

(22) PCT Filed: May 3, 2012

(86) PCT No.: PCT/US2012/036266

§ 371 (c)(1), (2), (4) Date: Feb. 14, 2014

(87) PCT Pub. No.: WO2012/151367

PCT Pub. Date: Nov. 8, 2012

(65) Prior Publication Data

US 2014/0193996 A1 Jul. 10, 2014

Related U.S. Application Data

(60) Provisional application No. 61/482,060, filed on May 3, 2011.

(51) Int. Cl.

| | |
|---|---|
| ***H01R 13/64*** | (2006.01) |
| ***H01R 13/645*** | (2006.01) |
| ***H01R 12/70*** | (2011.01) |

(52) U.S. Cl.

CPC ..... *H01R 13/6456* (2013.01); *H01R 12/7005* (2013.01); *H01R 13/64* (2013.01)

(58) Field of Classification Search

CPC ..... H01R 13/64; H01R 13/6456

USPC ..... 439/677, 680, 681, 341

See application file for complete search history.

(56) References Cited

U.S. PATENT DOCUMENTS

| | | | | |
|---|---|---|---|---|
| 2,899,669 | A * | 8/1959 | Johanson | H01R 13/28 439/157 |
| 3,184,707 | A * | 5/1965 | Anderson | H01R 13/00 174/59 |
| 3,299,392 | A * | 1/1967 | Evans | H01R 23/68 439/62 |

(Continued)

FOREIGN PATENT DOCUMENTS

| | | |
|---|---|---|
| EP | 0274609 A1 | 7/1988 |
| EP | 0443492 B1 | 4/1995 |

OTHER PUBLICATIONS

Supp. European Search Report; 6pp., Jan. 15, 2015, CardioInsight Technologies, Inc.

(Continued)

*Primary Examiner* — Ross Gushi

(74) *Attorney, Agent, or Firm* — Tarolli, Sundheim, Covell & Tummino LLP

(57) ABSTRACT

Uniquely positioned slots are provided in the receptacle and uniquely positioned bosses are provided in the plug of a connector pair. These features are designed to prevent the plug from being inserted midspan and damaging the exposed contacts of the receptacle. The bosses may be located near outside corners of the plug, and may protrude sufficiently from the face of the plug to prevent the corners of the plug from being inserted into the receptacle, except when the bosses are aligned with the boss-receiving slots in the receptacle.

17 Claims, 4 Drawing Sheets

(56) References Cited

U.S. PATENT DOCUMENTS 3,408,612 A * 10/1968 Bute ..... H01R 13/665 439/526
3,617,985 A * 11/1971 Kehl ..... H01R 23/10 439/341
4,257,665 A * 3/1981 John ..... H01R 13/64 439/341
4,376,565 A * 3/1983 Bird ..... H01R 13/6456 439/681
4,503,608 A * 3/1985 Evans ..... H05K 3/3405 29/839
4,580,868 A * 4/1986 Verstijnen ..... H01R 13/6456 439/680
4,586,766 A * 5/1986 Hofmeister ..... H01R 13/62933 439/160
4,726,791 A * 2/1988 Rudy, Jr. ..... H01R 13/6453 439/677
4,813,892 A * 3/1989 Strate ..... H01R 13/64 439/680
4,869,681 A * 9/1989 Vache ..... H05K 7/1461 439/341
4,923,408 A * 5/1990 Zinn ..... H01R 13/516 439/341
4,960,387 A * 10/1990 Davis ..... H01R 13/629 439/374
4,986,769 A * 1/1991 Adams, III ..... H01R 13/64 439/347
5,044,994 A * 9/1991 Van Woensel ..... H01R 13/6456 439/681
5,116,239 A * 5/1992 Siwinski ..... H01R 12/79 439/496
5,137,467 A * 8/1992 Arai ..... H01R 13/629 439/374
5,238,418 A * 8/1993 Koiner ..... H01R 13/64 439/157
5,273,462 A * 12/1993 Huser ..... H01R 13/645 439/341
5,302,136 A * 4/1994 St. Germain ..... H01R 13/631 439/341
5,370,556 A * 12/1994 Olsson ..... H01R 13/645 439/677
5,458,497 A * 10/1995 Yasumura ..... H01R 12/721 439/341
5,460,548 A * 10/1995 Roth ..... H01R 13/64 439/374
5,466,171 A * 11/1995 Bixler ..... H01R 13/64 439/378
5,584,721 A * 12/1996 Taniuchi ..... H01R 13/62938 439/374
5,816,842 A * 10/1998 Thantrakul ..... G11B 33/122 439/374
5,865,651 A * 2/1999 Dague ..... H01R 29/00 439/218
5,890,931 A * 4/1999 Ittah ..... H01R 13/6456 439/677
5,921,796 A * 7/1999 Morlion ..... G02B 6/3869 439/247
5,966,023 A * 10/1999 Burgers ..... G01R 1/0416 324/750.25
5,980,283 A * 11/1999 Okabe ..... H01R 13/62955 439/157
6,065,982 A * 5/2000 Okabe ..... H01R 13/62933 439/157
6,183,282 B1 * 2/2001 Okabe ..... H01R 13/62933 439/310
6,224,403 B1 * 5/2001 Okabe ..... H01R 13/62955 439/157
6,247,978 B1 * 6/2001 Wu ..... H01R 13/432 439/687
6,250,937 B1 * 6/2001 Okabe ..... H01R 13/62955 439/157
6,254,409 B1 * 7/2001 Okabe ..... H01R 13/62955 439/157
6,319,068 B1 * 11/2001 Bao ..... B29C 45/26 439/660
6,334,794 B1 * 1/2002 Crane, Jr. ..... H01R 12/7047 439/680
6,356,454 B1 * 3/2002 Braunlich ..... H05K 7/1454 361/714
6,358,089 B1 * 3/2002 Kuroda ..... H01R 12/716 439/607.13
6,364,718 B1 * 4/2002 Polgar ..... H01R 13/64 439/488
6,386,923 B2 * 5/2002 Sugiura ..... H02G 3/16 439/680
6,679,733 B2 * 1/2004 Crane, Jr. ..... H01R 12/7047 439/660
6,733,343 B2 * 5/2004 Morita ..... H01R 13/6456 439/680
6,767,239 B2 * 7/2004 Fukamachi ..... H01R 13/6456 439/374
6,796,815 B2 * 9/2004 Okabe ..... H01R 13/6295 439/157
6,808,428 B1 * 10/2004 Korsunsky ..... H01R 12/7052 439/680
6,869,319 B2 * 3/2005 Yamada ..... H01R 13/6456 439/607.01
6,953,370 B2 * 10/2005 Matsuoka ..... H01R 13/64 439/489
7,118,402 B2 * 10/2006 Takada ..... H01R 31/06 439/341
7,281,933 B1 * 10/2007 Shigeta ..... H01R 13/62955 439/157
7,316,590 B2 * 1/2008 Zueck ..... H01R 13/6456 439/681
7,393,220 B1 * 7/2008 Kwang ..... H01R 13/62938 439/157
7,422,486 B2 * 9/2008 Hoff ..... G06F 3/023 439/655
7,520,785 B2 * 4/2009 Aihara ..... H01R 12/712 439/680
7,896,683 B1 * 3/2011 Ratzlaff ..... H01R 13/631 439/374
8,182,296 B2 * 5/2012 De Blieck ..... H01R 43/16 439/378
8,323,059 B1 * 12/2012 Song ..... H01R 13/64 439/680
8,337,255 B2 * 12/2012 Shamoto ..... H01R 13/6456 439/680
8,608,503 B2 * 12/2013 Kagotani ..... H01R 12/7005 439/378
8,888,522 B2 * 11/2014 Schrader ..... H01R 13/64 439/353
8,986,033 B2 * 3/2015 Berger ..... H05K 7/1468 439/341
2001/0039144 A1 * 11/2001 Osawa ..... H01R 13/5202 439/589
2002/0111078 A1 * 8/2002 Sevier ..... H01R 13/6456 439/680
2002/0182918 A1 * 12/2002 Okabe ..... H01R 13/62933 439/341
2014/0148023 A1 * 5/2014 Venaleck ..... H05K 3/3405 439/78
2014/0187099 A1 * 7/2014 Venaleck ..... H01R 13/04 439/660
2014/0193996 A1 * 7/2014 Walters ..... H01R 12/7005 439/353

OTHER PUBLICATIONS

PCT Int'l Search Report and Written Opinion—6 pgs., Nov. 23, 2012, CardioInsight Technologies, Inc.

* cited by examiner

Fig. 3
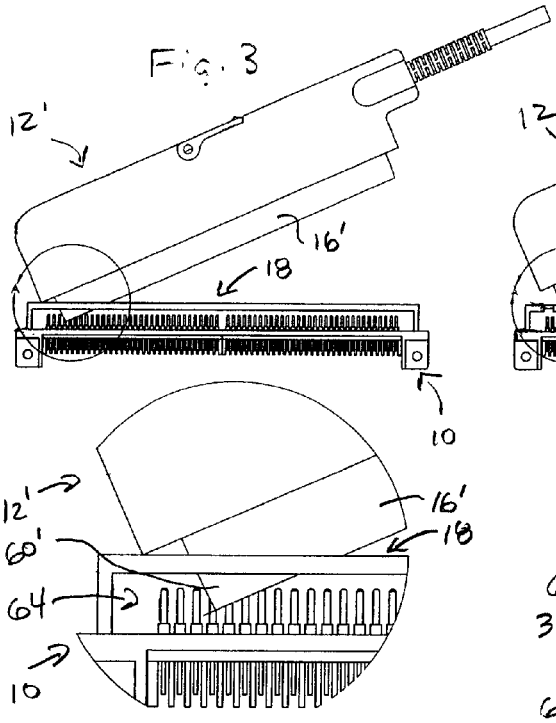
Fig. 4
Fig. 5
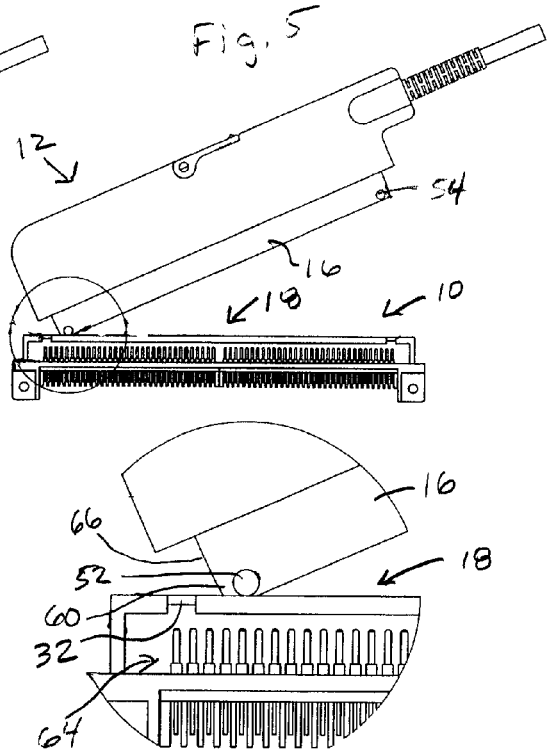
Fig. 6

ELECTRICAL CONNECTOR PLUG WITH KEY TO AVOID CONTACT DAMAGE

This application is a U.S. National Stage Application filed under 35 U.S.C. §371 of PCT/US2012/036266, having a filing date of May 3, 2012, which claims the benefit of U.S. Provisional Patent Application No. 61/482,060, filed on May 3, 2011, and entitled ELECTRICAL CONNECTOR PLUG WITH KEY TO AVOID CONTACT DAMAGE. The entire contents of each of the above-identified patent applications are incorporated herein by reference.

BACKGROUND

Many industry standard connector receptacles contain an open-contact pattern. These exposed contacts can be bent or damaged if the mating plug is inserted midspan such that one corner of the plug will contact the contacts. While most connecting pairs have integral polarization features, preventing the plug from being inserted backward, these features typically do not prevent the plug from partially entering the receptacle at the wrong location. Accordingly, it would be desirable to supply features that both prevent backward insertion and forces end-to-end alignment.

SUMMARY OF THE INVENTION

According to one aspect of the invention, slots are provided at the extreme ends of the receptacle and on one side.

According to yet another aspect of the invention, bosses are provided at the extreme ends of the plug on one side such that they will mate when the plug is properly positioned.

According to a further aspect of the invention, ribs could be substituted for the bosses in the same extreme location.

According to another aspect of the invention, the bosses or ribs protrude such that they prevent the plug from entering the receptacle except where the slots are located.

According to a further aspect of the invention, the combination of a receptacle connector and a plug that mates with the receptacle connector by insertion of an insert portion of the plug into an opening of the receptacle connector, may include one or more of the following features: the receptacle connector has a pair of boss-receiving slots at opposite ends of the opening; the boss-receiving slots are on an edge of the connector that abuts the opening; the receptacle connector also has one or more polarization slots for receiving one or more polarization keys of the plug; the one or more polarization slots are on an edge of the receptacle connector that is opposite the edge that includes the boss-receiving slots; the receptacle connector has a pair of the polarization slots; the plug includes a pair of bosses at opposite ends of the insert portion; the bosses are on the same side of the insert portion; the bosses function as stops that prevent corners of the insert portion from being inserted into the opening so as to damage contacts of the receptacle connector; the bosses are circular; the bosses prevent substantial insertion of the insert portion except when one of the bosses is aligned with one of the boss-receiving slots; the plug has polarization keys on the plug insert portion; the polarization keys are on an opposite side of the insert portion than the bosses; the polarization keys have substantially the same shape as the bosses; the polarization keys have curved side surfaces; the curved side surfaces have different curvatures for the proximal curved sides surfaces and the distal curved side surfaces; the curved side surfaces are configured to allow the polarization keys to enter the polarization slots when the plug is pivoted about one of the bosses that has been inserted into one of the boss-receiving slots.

According to a still further aspect of the invention, a device includes: a receptacle connector; and a plug that mates with the receptacle connector by insertion of an insert portion of the plug into an opening of the receptacle connector. The receptacle connector has a pair of boss-receiving slots at opposite ends of the opening.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

FIG. 3 is a side view of a modified plug, without bosses, being incorrectly inserted in a mating receptacle connector.

FIG. 4 is a magnified side view showing a portion of the incorrect insertion shown in FIG. 3.

FIG. 5 is a side view showing how bosses on the plug of the device of FIG. 1 prevent incorrect insertion of the plug.

FIG. 6 is a magnified side view showing a portion of the incorrect insertion prevention shown in FIG. 5.

DETAILED DESCRIPTION

Uniquely positioned slots are provided in the receptacle and uniquely positioned bosses are provided in the plug of a connector pair. These features are designed to prevent the plug from being inserted midspan and damaging the exposed contacts of the receptacle. The bosses may be located near outside corners of the plug, and may protrude sufficiently from the face of the plug to prevent the corners of the plug from being inserted into the receptacle, except when the bosses are aligned with the boss-receiving slots in the receptacle.

Figure 1:
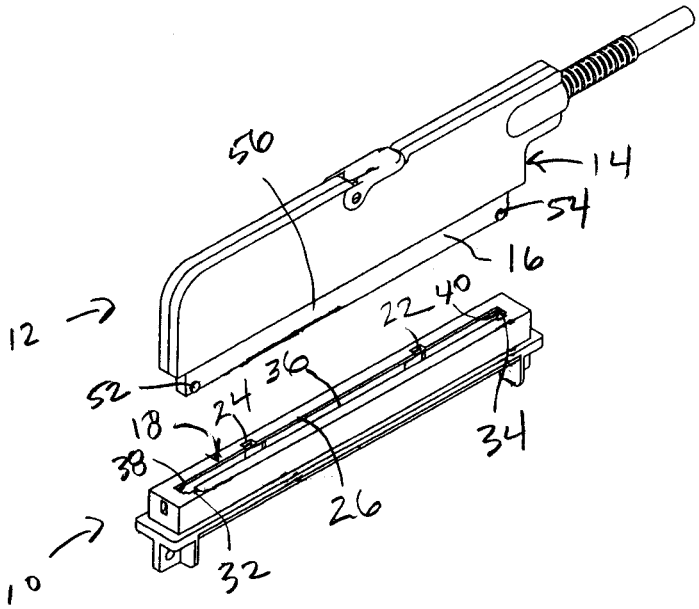
FIG. 1 is an oblique view of a device in accordance with an embodiment of the invention.
Figure 2:
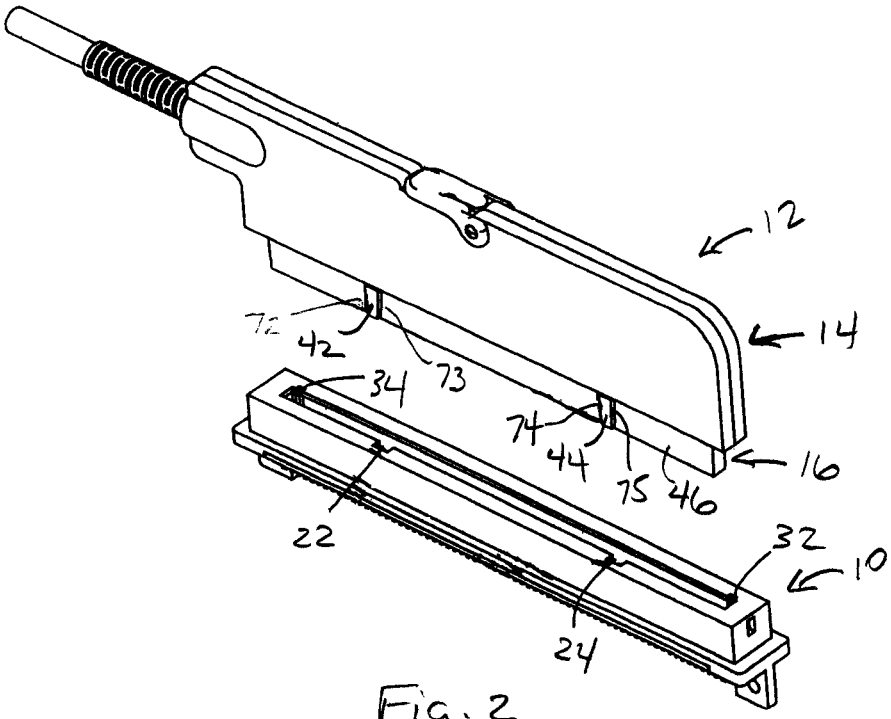
FIG. 2 is another oblique view of the device of FIG. 1.

FIGS. 1 and 2 show a device that includes a receptacle connector 10 and a mating plug connector 12. The receptacle connector 10 engages the mating plug connector 12. The plug 12 includes a housing 14 with an insert portion 16 that is inserted into an opening 18 of the receptacle connector 10. The plug 12 has electrical contacts (not shown) that engage contacts inside the opening 18.

The receptacle 10 and the plug 12 include features to allow insertion only when the plug insert portion 16 is properly aligned with the opening. In addition the features may aid in connection between the proper receptacles and plugs, where more than one receptacle and/or more than one plug is available for connection. The features on the receptacle 10 include a pair of a pair of polarization slots 22 and 24 on a first edge 26 of the opening 18, and a pair of boss-receiving slots 32 and 34 on a second edge 36 of the opening 18, where the second edge 36 is on an opposite side of the opening 18 from the first edge 26. The first and second edges 26 and 36 are the long edges around the opening 18, and are connected by a third edge 38 and a fourth edge 40 (the short edges). The first and second edges 26 and 36 may be parallel to each other.

The plug insert portion 16 has corresponding protrusions that fit into and engage the slots 22, 24, 32, and 34: a pair of polarization keys 42 and 44 on a first side 46 of the insert portion 16, and a pair of bosses 52 and 54 on a second (opposite) side 56 of the insert portion 16. Having the polarization keys 42 and 44 and the bosses 52 and 54 on opposite sides helps keep the bosses 52 and 54 from accidently being inserted into the polarization slots 22 and 24. In the illustrated embodiment the bosses 52 and 54 and the boss-receiving slots 32 and 34 are at ends of the plug 12 and the opening 18, respectively. The polarization keys 42 and 44 and the polarization slots 22 and 24 are closer to a center of the plug insert portion 16 and the opening 18.

The bosses 52 and 54 are used to prevent corners from being inserted into the opening in such a way as to damage the contacts of the receptacle 10 that are accessible through the opening 18. The potential problem is illustrated in FIGS. 3 and 4, where a modified plug 12' is shown interacting with the receptacle connector 10. The modified plug 12' is the same as the plug 12 (FIG. 1), except that the bosses 52 and 54 (FIG. 1) are removed from a plug insert portion 16'. Without the presence of the bosses 52 and 54 the plug portion 16' is thin enough to allow its corner 60' to be inserted into the opening 18 midspan. The corner 60' can be inserted far enough to come into contact with and potentially damage connector contacts 64 that are in the receptacle connector 10. The damage from insertion of a corner of the plug 12' may render the receptacle 10 unable to mate with the plug, or otherwise unable to perform its intended function.

FIGS. 5 and 6 illustrate how the bosses 52 and 54 prevent damage to the receptacle contacts 64. When a corner 60 of the plug portion 16 is inserted into the opening midspan, away from the boss-receiving slot 32, the boss 52 prevents more than an insubstantial part of the plug portion 16 from being inserted into the opening 18. Unless the boss 52 is aligned with the boss-receiving slot 32, the boss 52 contacts the connector 10 along the second edge 36, which abuts the connector opening 18. The boss 52 thus acts as a stop, preventing the corner 60 from being inserted far enough to reach the contacts 64. Thus damage to the contacts 64 from initial misalignment is prevented.

The boss 52 does not act as a stop when it is aligned with the boss-receiving slot 32. However even in this case the plug 12 must be properly aligned before it can be inserted far enough to engage the contacts 64. If the plug 12 is tilted, for example at the angle shown in FIGS. 5 and 6, then a side surface 66 of the insert portion 16 will come into contact with the third edge 38 (FIG. 1) of the connector 10 before the corner 60 can be inserted far enough to damage the receptacle contacts 64.

The polarization keys 42 and 44 may be used to differentiate between different types of receptacle-plug combinations. Different types of plugs and receptacles may have their polarization keys and polarization slots at different locations, and/or having different geometries. This prevents mating of plugs with receptacles of different types (not the same type as the plug).

Referring back to back to FIG. 2, the polarization keys 42 and 44 have respective pairs of curved side surfaces. The polarization key 42 has curved side surfaces 72 and 73, and the polarization key 44 has curved side surfaces 74 and 75. The curved surfaces 72-75 are configured to allow the keys 42 and 44 to smoothly enter the polarization slots 22 and 24 when the plug insert portion 16 is inserted into the opening 18 by first inserting one of the bosses 52 and 54 (FIG. 1) into the corresponding boss-receiving slot 32 and 34 (FIG. 1), and then rotating the plug 12 about the inserted boss. When the boss 52 is inserted into the slot 32 and pivoted about, the curved surfaces 72 and 74 need to clear the side walls of the polarization slots 22 and 24, respectively. Since the surface 74 is closer than the surface 72 to the pivot point (the boss 52), the surface 74 has greater curvature than the surface 72. When the boss 54 is inserted into the slot 34 and pivoted about, the curved surfaces 73 and 75 need to clear the side walls of the polarization slots 22 and 24, respectively. Since the surface 73 is closer than the surface 75 to the pivot point (the boss 54), the surface 73 has greater curvature than the surface 75. Therefore the proximal curved surfaces 73 and 74, the curved surfaces closer to the center of the plug 12, may have a greater curvature than the distal curved surfaces 72 and 75.

The connector 10 and the plug 12 may be made of suitable materials. The bodies of the connector 10 and the plug 12 may be made of plastic, each including one or more pieces of molded plastic. The contacts in the connector 10 and the plug may be made of suitable metals, such as copper.

Figure 7:
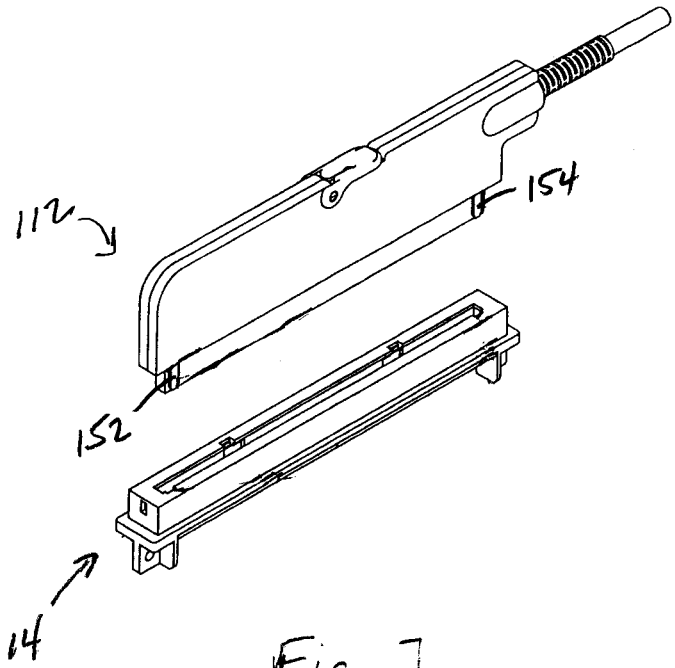
FIG. 7 is an oblique view of an alternate embodiment device in accordance with the invention.

The bosses 52 and 54 are circular in the illustrated embodiment, but other alternative shapes are possible. FIG. 7 shows an alternative embodiment plug 112 used to engage the connector 10, with the plug 112 and the connector 10 constituting an alternate embodiment device. The plug 112 is similar to the plug 12 (FIG. 1) except that the plug 112 has keys or ribs 152 and 154 instead of the circular bosses 52 and 54 (FIG. 1) of the plug 12. The keys 152 and 154 may have the same shape as the polarization keys 42 and 44 (FIG. 2) of the plug 12. The bosses may alternatively be ribs of any of a variety of suitable shapes.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A device comprising:

a receptacle connector comprising a pair of boss-receiving slots at opposite ends of an opening and polarization slots for receiving polarization keys; and a plug that mates with the receptacle connector by insertion of an insert portion of the plug into the opening of the receptacle connector, wherein the insert portion comprises a pair of bosses at opposite ends and polarization keys that comprise respectively a pair of curved side surfaces, wherein the pair of curved side surfaces of a given polarization key has different curvatures for a proximal curved sides surface of the pair of curved side surfaces and distal curved side surface of the pair of curved side surfaces.

2. The device of claim 1, wherein the polarization slots are on a given edge that abuts the opening for receiving the polarization keys of the plug.

3. The device of claim 2, wherein the given edge and an opposite edge that abuts the opening are parallel with respect to each other; and wherein the polarization slots are on an edge of the receptacle connector that is on an opposite edge of the receptacle connector that includes the pair of boss-receiving slots.

4. The device of claim 2, wherein the polarization slots is a pair of polarization slots located on an opposite edge that abuts the opening of the receptacle connector.

5. The device of claim 2, wherein the pair of bosses are positioned at opposite ends on a common side of the insert portion.

6. The device of claim 5, wherein the pair of bosses function as stops to prevent corners of the insert portion from being inserted into the opening so as to damage contacts of the receptacle connector in the opening during mating of the plug with the receptacle connector.

7. The device of claim 5, wherein the pair of bosses are a pair of circular bosses.

8. The device of claim 5, wherein the polarization keys are positioned on an opposite side of the insert portion.

9. The device of claim 8, wherein the polarization keys are located closer to a center portion of the insert portion than the pair of bosses.

10. The device of claim 8, wherein the pair of bosses are located closer to distal ends of the insert portion than the polarization keys.

11. A device comprising:

a receptacle connector comprising a pair of boss-receiving slots at opposite ends of an opening and polarization slots for receiving polarization keys; and a plug that mates with the receptacle connector by insertion of an insert portion of the plug into the opening of the receptacle connector, wherein the insert portion comprises a pair of bosses at opposite ends and polarization keys that comprise respectively a pair of curved side surfaces, wherein the respective pair of curved side surfaces of the polarization keys are configured to allow the polarization keys to enter corresponding polarization slots when the plug is pivoted about one of the bosses of the pair of bosses that has been inserted into a corresponding boss receiving slot of the pair of boss-receiving slots.

12. The device of claim 11, wherein the pair of bosses are configured to prevent substantial insertion of the insert portion into the opening except when at least one of the pair of bosses is aligned with a respective boss receiving slot of the pair of boss-receiving slots.

13. The device of claim 11, wherein the polarization slots are on a given edge that abuts the opening, the polarization slots being configured to receive the polarization keys of the insert portion during mating of the plug with the receptacle connector.

14. The device of claim 13, wherein the polarization keys are on an opposite side of the insert portion than the pair of bosses.

15. The device of claim 14, wherein the polarization keys have a substantially similar shape as the pair of bosses.

16. The device of claim 11, wherein the pair of bosses are positioned at opposite ends on a common side of the insert portion;

wherein the pair of bosses function as stops to prevent corners of the insert portion from being inserted into the opening so as to damage contacts of the receptacle connector in the opening; and wherein the pair of bosses are configured to prevent substantial insertion of the insert portion except when at least one of the pair of bosses is aligned with a respective boss receiving slot of the pair of boss-receiving slots.

17. The device of claim 16, wherein the pair of bosses are a pair of circular bosses.

* * * * *